United States Patent [19]

Nicodemus

[11] Patent Number: 4,569,635

[45] Date of Patent: Feb. 11, 1986

[54] HYDROKINETIC AMPLIFIER

[75] Inventor: Carl D. Nicodemus, Caledonia, N.Y.

[73] Assignee: Helios Research Corp., Mumford, N.Y.

[21] Appl. No.: 612,742

[22] Filed: May 21, 1984

Related U.S. Application Data

[63] Continuation-in-part of Ser. No. 517,821, Jul. 27, 1983, abandoned, which is a continuation-in-part of Ser. No. 236,918, Feb. 23, 1981, abandoned, which is a continuation-in-part of Ser. No. 42,967, May 29, 1979, abandoned.

[51] Int. Cl.[4] ..... F04F 5/00

[52] U.S. Cl. ..... 417/196; 417/178; 417/197

[58] Field of Search ..... 417/197, 196, 176, 77, 417/54, 192, 151, 198, 181, 174, 178, 177

[56] References Cited

U.S. PATENT DOCUMENTS

| | | | |
|---|---|---|---|
| 697,770 | 4/1902 | Allen | 417/192 |
| 1,328,139 | 1/1920 | Elliott | 417/185 X |
| 1,447,103 | 2/1923 | Schmidt | 417/196 |
| 2,046,887 | 7/1936 | Walch . | |
| 2,288,962 | 7/1942 | Turner . | |
| 2,369,692 | 2/1945 | Tinker . | |
| 2,915,987 | 12/1959 | McMahon . | |
| 3,288,685 | 11/1966 | Kemper et al. . | |
| 3,934,799 | 1/1976 | Hull . | |
| 4,060,355 | 11/1977 | Walz et al. . | |
| 4,183,331 | 1/1980 | Hull . | |
| 4,252,572 | 2/1981 | Schaming . | |

OTHER PUBLICATIONS

"Low Level Condensers, Educator and Multi-Jet Type", Bulletin 5AB, Ametek, Schutte & Koerting Division, 1980.

*Primary Examiner*—Edward K. Look
*Attorney, Agent, or Firm*—Stonebraker, Shepard & Stephens

[57] ABSTRACT

A hydrokinetic amplifier 10 uses liquid and vapor input nozzles 11 and 12 discharging into an acceleration chamber 13 downstream from which a diverging diffuser 15 extends. Liquid nozzle 11 forms a free liquid jet 20 that extends for a substantial distance through acceleration chamber 13, and vapor flowing at a much higher speed into acceleration chamber 13 surrounds, impinges on, and condenses into free liquid jet 20. Collapse of the condensing vapor forms a suction into which more vapor flows. Acceleration chamber 13 gradually converges from an ingress region 14 receiving liquid and vapor to an egress region 16 flowing mostly liquid into diffuser 15. Vapor nozzle 12 has a throat region **12*a* arranged upstream of the discharge region 21 of liquid nozzle 11 and an expanding region 12*b* extending from throat region 12*a* downstream toward ingress region 14 of acceleration chamber 13 so that vapor is expanding when it contacts the liquid. The vapor surrounds and travels in the direction of free liquid jet 20 so that substantially more than half of the expanding vapor contacts and condenses in liquid jet 20, transferring momentum energy from the vapor to the liquid to accelerate the liquid toward egress region 16**.

18 Claims, 5 Drawing Figures

HYDROKINETIC AMPLIFIER

RELATED APPLICATIONS

This application is a continuation-in-part of my parent application Ser. No. 517,821, filed July 27, 1983, entitled Hydrokinetic Amplifier, which was a continuation-in-part of my grandparent application Ser. No. 236,918, filed Feb. 23, 1981, entitled Hydrokinetic Amplifier, which was a continuation-in-part of my great grandparent application Ser. No. 042,967, filed May 29, 1979, entitled Fluid Pressure Amplifier and Condenser. All preceding applications were abandoned upon filing of successor applications, and the full disclosure of my parent application Ser. No. 517,821 and grandparent application Ser. No. 236,918 are hereby incorporated into this continuation-in-part application.

BACKGROUND

Since the mid-1800's, injectors have exploited the ability of steam to combine with water into which the steam condenses, transferring its momentum energy, for outputting liquid at a pressure higher than the steam input pressure. My hydrokinetic amplifier also transfers vapor energy to liquid to increase the output pressure, but it does this much more efficiently than an injector. With hindsight knowledge of how my hydrokinetic amplifier works, it is clear that steam injectors suffered large friction losses in accelerating water while the water engaged in internal wall. My hydrokinetic amplifier accelerates liquid in a free jet surrounded by vapor and avoids the large friction losses from accelerating water along a wall.

Some prior art jet pumps, such as fluid heaters, have also used a liquid jet spaced from a wall and surrounded by vapor, but these have failed to achieve a substantial pressure gain. Hindsight now suggests that they could have been designed to increase pressure, but actual practice shows that they were designed merely to heat the liquid. They failed to accelerate the vapor to a high velocity, they lacked a sufficient distance for the vapor to condense in the liquid and transfer its kinetic energy before reaching a diffuser, and they lacked a small enough discharge opening to pass mostly liquid through a diffuser for efficiently converting kinetic energy to pressure.

My hydrokinetic amplifier suffers none of these shortcomings. It is structured to maximize the kinetic energy of the vapor, transfer as much of that kinetic energy as possible to a free liquid jet, keep friction losses to a minimum, and efficiently convert liquid velocity to liquid pressure at the output diffuser. Thus, by a combination of efficiency-improving strategies, my hydrokinetic amplifier produces a surprisingly large pressure amplification that can exceed the sum of the absolute liquid and vapor input pressures by a factor of four. This readily beats injectors, the best of which cannot double the absolute liquid and vapor input pressures.

The collapse of vapor condensing within my hydrokinetic amplifier produces a suction that can draw in operating vapor from a subatmospheric pressure source. This allows my hydrokinetic amplifier to produce a substantial pressure gain from a subatmospheric pressure vapor—a feat unachievable by injectors, which cannot function at all with subatmospheric pressure vapor, or by fluid heaters, which do not produce more than incidental pressure gain and require a pressurized source of liquid to entrain the subatmospheric vapor.

The suction can also draw in subatmospheric pressure liquid at the same time that subatmospheric pressure vapor is providing the motive power. So unlike prior art jet pump devices that require a pressurized fluid to entrain a subatmospheric pressure fluid, my hydrokinetic amplifier can operate on subatmospheric pressure vapor without any high pressure entrainment. This allows my hydrokinetic amplifier to vaporize and condense liquids at subatmospheric pressures without using vacuum pumps.

The superior capabilities of my hydrokinetic amplifier can be exploited in a variety of ways that include condensing, evaporating, cooling, pumping, forming jets, entraining fluids, transferring heat, liquifying gas, and producing warmed and pressurized liquid output.

SUMMARY OF THE INVENTION

My hydrokinetic amplifier discharges a free liquid jet into an ingress region of an acceleration chamber having a gradually converging wall so that the jet can be accelerated through the acceleration chamber without contacting the wall and thus incurring friction losses before reaching an egress region. Vapor also flows into the ingress region of the acceleration chamber through a vapor nozzle that directs expanding and much higher velocity vapor to surround and travel in the direction of the free liquid jet. The vapor nozzle, preferably surrounding the liquid nozzle, has a throat region arranged upstream of the discharge region of a liquid nozzle and an expanding region arranged from the throat region downstream toward the ingress region of the acceleration chamber. This can accelerate vapor to supersonic velocity at the ingress region. Since both the liquid and the much higher velocity vapor are proceeding in the same direction toward the egress region, a large part of the momentum energy of the speeding vapor transfers to the liquid as the vapor contacts and condenses in the liquid.

The free liquid jet accelerating through the acceleration chamber is long enough for condensing the merging vapor before reaching the egress region. Substantially more than half, and preferably at least about 90%, of the vapor condenses in the free liquid jet before reaching the egress region, and preferably the flow through the egress region is at least about 90% liquid. This often gives the egress region a smaller cross-sectional area than the discharge region of the liquid input nozzle, and it allows a diffuser extending downstream of the egress region to efficiently convert liquid velocity to pressure.

DRAWINGS

FIG. 1 is a schematic diagram of a preferred embodiment of my hydrokinetic amplifier; and FIGS. 2–5 are schematic views of the discharge ends of various preferred liquid input nozzles for the amplifier of FIG. 1.

DETAILED DESCRIPTION

Figure 1:
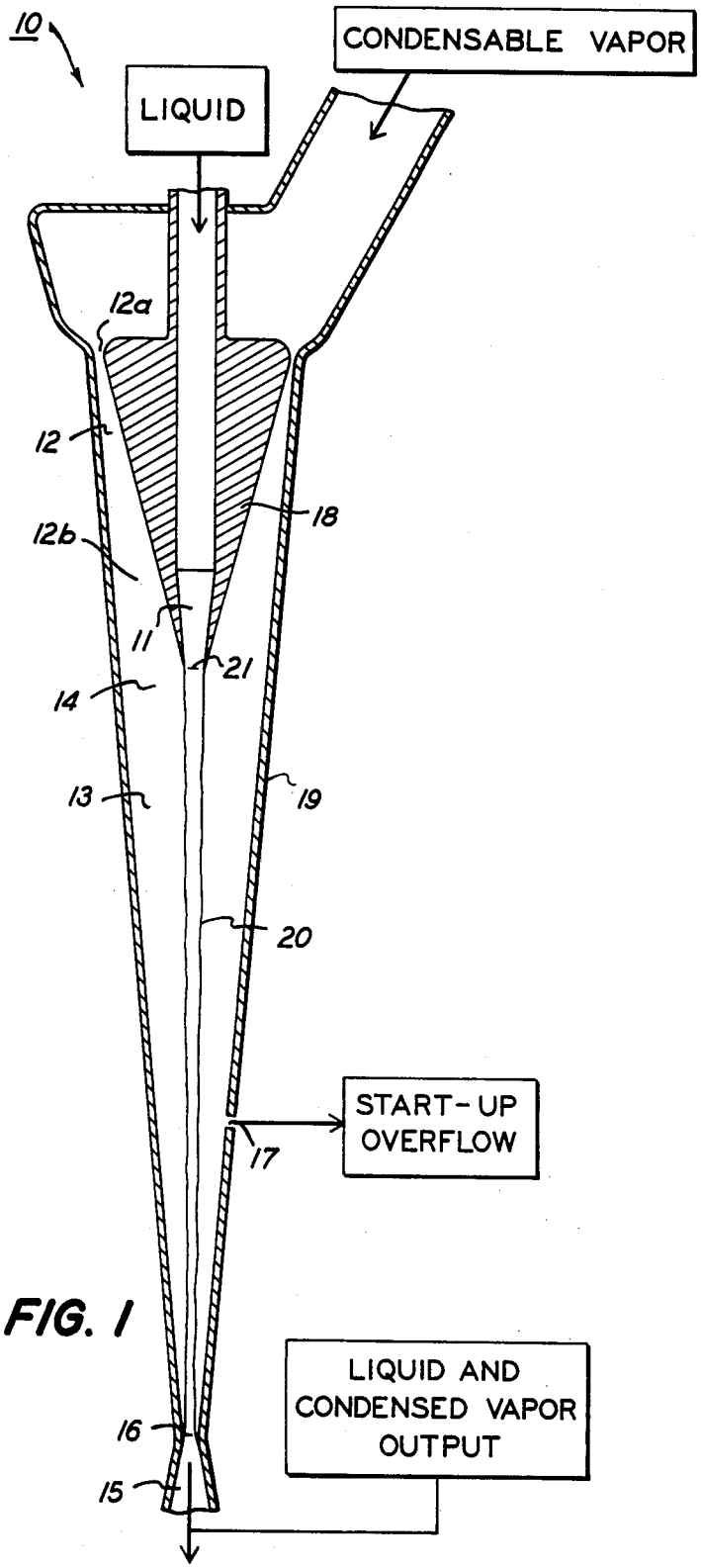

My hydrokinetic amplifier 10, as schematically shown in FIG. 1, includes a liquid input nozzle 11, a vapor input nozzle 12, and an acceleration chamber 13 with an ingress region 14 and an egress region 16, downstream from which a diffuser 15 extends. Liquid nozzle 11 forms a free liquid jet 20 that extends from ingress region 14 through acceleration chamber 13 to egress region 16 where it enters diffuser 15. The gradually converging wall 19 of acceleration chamber 13 preferably has a gap 17 arranged between the ingress and egress regions to facilitate start-up.

My hydrokinetic amplifier can have many configurations, shapes, and proportions other than the ones illustrated, provided its components embody the principle features and variations described below.

LIQUID INPUT NOZZLE

The main function of liquid input nozzle 11 is to form and direct free liquid jet 20 into ingress region 14 of acceleration chamber 13 so that liquid jet 20 passes through acceleration chamber 13 without contacting converging wall 19 before reaching egress region 16. Nozzle 11 is preferably a converging liquid nozzle with a discharge area 21 that determines the size and flow rate of jet 20 for a given difference between liquid input pressure and the lower pressure within acceleration chamber 13. Nozzle 11 is also preferably coaxial with acceleration chamber 13 and oriented to aim jet 20 vertically downward as illustrated, although other configurations and orientations can be made to work.

Figure 2:
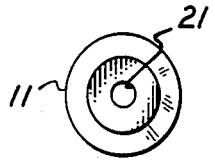
Figure 3:
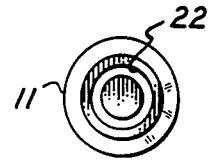
Figure 4:
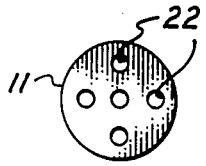
Figure 5:
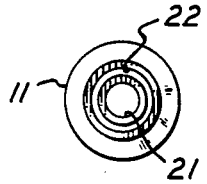

Among the many possible variations for liquid input nozzle 11, its discharge area 21 can be circular as shown in FIG. 2, annular as shown by opening 22 in FIG. 3, multiple openings 23 as shown in FIG. 4, or even multiple nozzles such as circular nozzle 21 surrounded by annular nozzle 22 as shown in FIG. 5. The discharge area, meaning the actual area of any opening through which liquid is discharged by nozzle 11 into acceleration chamber 13, establishes the flow rate for any given liquid pressure drop across the nozzle.

VAPOR INPUT NOZZLE

Vapor input nozzle 12 preferably surrounds liquid input nozzle 11 and directs a condensable vapor into acceleration chamber 13 to flow in the same general direction as liquid jet 20. Vapor nozzle 12 has a constricted throat region **12*a* arranged upstream of discharge region 21 of liquid nozzle 11. Downstream of throat region 12*a*, vapor nozzle 12 has an expanding region 12*b* formed between acceleration chamber wall 19 and an annular surface 18 around liquid nozzle 11. A sufficiently low suction pressure, caused by vapor condensing in acceleration chamber 13, preferably draws incoming vapor at sonic velocity through throat region 12*a* so that vapor expanding into expansion region 12*b* accelerates to supersonic velocity upon entering ingress region 14 and contacting liquid jet 20**. Vapor flow at a high rate and vapor acceleration to a high velocity are both desirable to produce a large liquid pressure gain.

Vapor nozzle 12 is preferably configured to produce maximum vapor momentum or thrust, and this can be derived from the art of rocket nozzles. Since high velocity vapor should surround and travel in the same direction as liquid jet 20, vapor nozzle 12 is preferably annular. The surrounding vapor helps keep liquid jet 20 away from contact with converging wall 19, and high velocity vapor speeding in the same direction as liquid in jet 20 is optimum for transferring the kinetic energy of the vapor to the liquid as the vapor contacts the liquid and condenses.

ACCELERATION CHAMBER

Acceleration chamber 13 has an adequate diameter at its ingress region 14 to receive high velocity vapor discharged from expansion region **12*b* of the vapor nozzle so that the vapor surrounds, merges with, and accelerates the liquid toward egress region 16. The wall 19 of acceleration chamber 13 preferably converges downstream at a taper of, for example, 2.5°. The wall can also be parallel or slightly divergent without appreciably diminishing performance. A long and gently converging acceleration chamber gives jet 20 an adequate length for optimum performance and directs vapor to impinge on jet 20** at a small angle to its direction of travel for effective transfer of momentum from vapor to liquid.

Vapor collapses as it condenses in liquid jet 20, and most of the vapor condenses before reaching egress region 16. The convergence of wall 19, directing vapor into jet 20, has a vapor-compressing tendency that is at least partially offset by the collapse of condensing vapor tending to cause vapor expansion. The pressure of the vapor stream flowing toward egress region 16 does not necessarily increase.

An ample length for free liquid jet 20 enhances its ability to condense merging vapor and accelerate to a high velocity that converts to a high pressure gain. It also helps merge and condense a high flow rate of incoming vapor transferring energy to the liquid. In prototypes of my hydrokinetic amplifier, I have operated free jets at lengths of over 25 times the diameter of egress region 16, and I have not yet discovered any upper limit for the jet length.

Substantially more than half, and preferably at least about 90%, of the incoming vapor condenses in liquid jet 20 during its passage through acceleration chamber 13. By the addition of condensate, the liquid increases in both velocity and flow rate so that the cross-sectional area of jet 20 diminishes as the jet advances. The discharge converging through egress region 16 is mostly liquid, which is preferred for efficient conversion of liquid velocity to pressure.

Egress region 16 has a minimum cross-sectional area that is preferably smaller than the discharge area 21 of liquid nozzle 11 and preferably only slightly larger than the cross-sectional area of the liquid jet flowing through. The outflow through egress region 16 is preferably at least about 90% liquid. The outflowing liquid engaging the converging and diverging wall of diffuser 15 efficiently converts the liquid's kinetic energy to output pressure.

OPERATION

My hydrokinetic amplifier can be operated under different conditions for different results such as high output pressure, high output temperature, high rate of vapor condensation, low vapor supply pressure, low liquid supply pressure, and high fluid entrainment capability. All these objectives involve converting vapor energy to a high velocity flow and transferring the kinetic energy of this to slower moving liquid in a free jet. Different objectives can also be mixed, and amplifier 10 can be structured and operated to fit its performance to a variety of circumstances.

Structural variations to accomplish different objectives can include size and shape of discharge area 21 of input nozzle 11, axial position of liquid nozzle 11, location and size of throat **12*a* of vapor nozzle 12, angle and length of expansion region 12*b*, surface area of free liquid jet 20, volume and diameter of ingress region 14 of acceleration chamber 13, convergence angle and length of acceleration chamber 13, size of egress region 16 and its distance from nozzle 11, and divergence angle and length of diffuser 15**. Besides structural variations, liquid and vapor input pressures, temperatures, and flow rates can vary; different fluids can be entrained; and many different operating liquids and vapors can be used. These possibilities all work within general operating principles and guidelines for varying the desired effects as explained below.

START-UP

Overflow 17 is preferred for most start-ups. Liquid and vapor can then be admitted to acceleration chamber 13 and can overflow through gap 17 until condensing vapor sufficiently accelerates jet 20 so that high velocity liquid flow fits through egress region 16. When this happens, a low pressure occurs at overflow 17, which preferably closes a check valve to prevent back flow from atmosphere.

If amplifier 10 is arranged to start with a low pressure discharge so it does not have to overcome a back pressure, overflow 17 can be omitted. Then start-up can be accomplished by a reduced flow liquid jet 20 small enough to fit through egress region 16. Vapor condensing in such a reduced flow start-up jet creates suction within chamber 13 and accelerates the jet so that the liquid flow can be increased to full operating flow.

CONDENSATION AND EVAPORATION

Vapor collapsing as it condenses in jet 20 forms a suction, drawing more vapor to chamber 13. This allows my amplifier to operate with subatmospheric pressure vapor drawn into the even lower pressure prevailing within acceleration chamber 13. Subatmospheric pressure liquid can also be drawn into acceleration chamber 13, even while my amplifier is operating with subatmospheric pressure vapor to produce a superatmospheric pressure output.

For subatmospheric pressure operation, a start-up arrangement must be used to draw liquid and vapor into acceleration chamber 13 so that vapor condensation there can create a suction drawing in subatmospheric pressure inputs. The ability of my hydrokinetic amplifier to draw operating vapor from a subatmospheric pressure source can be exploited in distillation, evaporation, and cooling processes.

The liquid temperature of jet 20 must be low enough to condense the incoming vapor; and for water and water vapor, I prefer a temperature difference of at least about 25°–30° C. Larger temperature differences also work, and minimum temperature differences vary with different liquids and vapors.

The condensation rate is also affected by the surface area of jet 20 and the velocity and density of the vapor. A larger jet surface area can condense more vapor by making more liquid surface available for impinging contact with vapor. High velocity and higher density vapors impinge vapor molecules onto the liquid jet at a faster rate and thus increase the condensation rate. As vapor accelerates to supersonic velocity, its temperature drops; and this decreases the temperature difference between the vapor and liquid. Condensation can still occur, but will be enhanced by a larger difference in temperature between the sources of incoming liquid and vapor.

Sonic velocity vapor passing through throat 12*a* of vapor nozzle 12 is preferred and is easily attained by a suction in ingress region 14 of 0.57 times the pressure of the vapor source. With acceleration chamber 13 dimensioned to receive expanding vapor, with an adequate surface area of jet 20, with an adequate temperature difference between the vapor and liquid sources, and with a properly shaped vapor throat 12*a* and expansion region 12*b*, vapor can attain supersonic velocity in acceleration chamber 13. This increases the kinetic energy of the vapor and provides substantial vapor momentum that transfers to liquid, accelerating the liquid to a higher velocity and yielding a higher output pressure.

If a low pressure output from diffuser 15 is satisfactory and maximum vapor flow is desired, then egress region 16 can be as large as or slightly larger than discharge area 21. An egress region of 1.6 times discharge area 21 is known to operate at moderate pressure amplification. This allows vapor input at a larger flow rate than can be condensed in the liquid jet before it reaches egress region 16, and it allows the oversupply of uncondensed vapor to flow with the liquid through egress region 16 whereupon the excess vapor condenses in diffuser 15.

My hydrokinetic amplifier has operated with vapor at subatmospheric pressures as low as 1.7 psia, or a vacuum of 27 inches of mercury. The low density of low pressure vapors makes the vapor condensation rate relatively small, but the vapor can be withdrawn from a low temperature source of liquid. Even such low pressure vapor can produce a sufficient pressure gain so that incoming water at about 12 psia is output at more than atmospheric pressure. Egress region 16 is preferably a little larger than liquid nozzle discharge region 21 to favor increased condensation instead of pressure gain.

PRESSURE AMPLIFICATION

For maximum pressure amplification, I prefer supersonic vapor, which has more transferable momentum and is more effective at driving vapor molecules into liquid molecules to accelerate the liquid. Supersonic vapor does not condense quite as rapidly as sonic velocity vapor, so jet 20 is preferably made especially long. Also, the increased momentum transfer and increased acceleration of the liquid reduces the cross-sectional flow area of jet 20 as it advances so that egress region 16 is made smaller than discharge area 21 for high pressure amplification. I have operated my hydrokinetic amplifier with an egress region area as small as 0.17 times discharge area 21 when liquid input pressure is especially low relative to vapor input pressure. There is reason to believe that egress region 16 could be even smaller.

For high pressure amplification, it is important that the liquid in jet 20 nearly fill egress region 16, through which it converges. This requires condensing nearly all the vapor by the time jet 20 reaches egress region 16, which can then be preferably about 90% filled with liquid. Overfilling floods the egress region and stalls the device.

Operating in a high pressure gain mode, my hydrokinetic amplifier has achieved absolute output pressures multiplying the sum of the absolute liquid and vapor input pressures by 4.7, for example, using atmospheric water and vapor inputs to produce an output pressure of 140 psia. Many examples of pressure gain factors range upwards from 3 times the absolute liquid and vapor inputs, and there is reason to believe that present gain factors can be increased. Prior art devices, in contrast, have not achieved a factor of 2 times the absolute liquid and vapor inputs.

For pressure gain, the prior art has used injectors with steam nozzles surrounded by water accelerated along a wall. Currently marketed injectors from Penberthy Division of Houdaille Industries, Inc., Prophetstown, Ill., produce an output pressure of "a little more than the steam pressure" for injectors supplied with water ranging from atmospheric pressure up to about 12 psig. Sellers Injector Systems, Prosser-East Division of Purex Corporation Ltd., Horsham, Pa., reports a higher pressure gain for a line of injectors supplied with tap water at undisclosed pressures assumed to be 40 to 60 psig. One of these models with steam at 40 psia can output 195 psia—for a pressure gain factor of nearly 2, depending on what water pressure is assumed. My hydrokinetic amplifier, using the same water and steam inputs, readily exceeds this.

My hydrokinetic amplifier can accept water input pressures ranging from well below to far above atmospheric pressure, reaching as high as several thousand psia. No prior art jet pump can accept input water over such a wide range of pressures while producing a pressure gain. My hydrokinetic amplifier can also operate with subatmospheric pressure vapor, which cannot be used to drive prior art injectors. Not only is the performance spectrum of my hydrokinetic amplifier broader in ranging much farther over permissible values of liquid and vapor input pressures, but its pressure gain performance is better than the prior art for any comparable inputs.

My hydrokinetic amplifier also invites comparison with prior art fluid heaters having a water jet surrounded by steam flow. Some fluid heaters produce moderate liquid pressure gain at low pressure liquid input values, but they suffer a pressure decrease at higher levels of water input pressure. Their discharge pressures are also less than, instead of several times, the sum of their absolute steam and water input pressures.

HIGH TEMPERATURE OUTPUT

Making the vapor condensation rate high compared to the liquid flow rate produces high output temperatures. Using hotter and higher pressure vapors combined with hotter liquids also produces hotter outputs. In pumping return water to a boiler, for example, hydrokinetic amplifiers can be staged and powered by successively higher pressure vapor as the temperature and pressure of liquid input increases at each successive stage until the final output exceeds the boiler pressure and is as hot as is practically possible.

Another way to increase output temperature is to entrain vapor in the high velocity fluid flow through egress region 16. More of the same vapor that enters the vapor input nozzle and drives the liquid flow can be entrained at egress region 16 to bring the liquid output temperature close to the vapor temperature. Other vapors, gasses, and liquids can also be entrained.

ANALYSIS OF OPERATION

Analysis of the operation of my hydrokinetic amplifier can be expressed in the following relationship:

$$\frac{P_{out}}{P_{in}} \cong \frac{\Delta P_{out}}{\Delta P_{in}} = F\frac{V_{L2out}}{V_{L2in}} = FC^2\frac{\left(\frac{M_V V_V}{M_L V_L}+1\right)^2}{\left(1+\frac{M_V}{M_L}\right)^2}$$

where:

F=efficiency of said diffuser

C=portion of vapor momentum transferred to liquid $M_V$=vapor mass flow rate $M_L$=liquid mass flow rate $V_V$=vapor velocity at said ingress region $V_L$=liquid velocity at said ingress region $P_{in}$=liquid pressure input $P_{out}$=liquid pressure output $\Delta P_{out}=P_{out}$—internal pressure at egress region $\Delta P_{in}=P_{in}$—internal pressure at ingress region Under the many operating circumstances in which the internal egress region pressure is much less than $P_{out}$ and the internal liquid pressure in the ingress region is much less than $P_{in}$ then:

$$\frac{\Delta P_{out}}{\Delta P_{in}} \sim \frac{P_{out}}{P_{in}}$$

For the special case of a large water input tube and low values of $P_{in}$, the internal liquid pressure at the ingress region may be an appreciable fraction of $P_{in}$. In this case, it is appropriate to regard $$\frac{\Delta P_{out}}{\Delta P_{in}}$$

as the effective pressure gain, which is always given by the equality in the above equation.

From the equation, it is apparent that increasing the velocity and mass flow rate of the vapor at ingress region 14 can have a predominant effect on pressure gain. Liquid velocity and mass flow rate at ingress region 14 are far smaller and not so readily varied, but vapor can be accelerated to supersonic velocities that can greatly increase its transferable momentum.

My hydrokinetic amplifier improves over prior art injectors by increasing the value of C, the decrement from unity of which represents internal losses, mostly from fluid friction. *Marks' Standard Handbook for Mechanical Engineers,* Eighth Edition, McGraw-Hill Book Company, at page 14—14, gives a C value of 0.5 for prior art injectors. My hydrokinetic amplifier can operate at C values of 0.6 and higher. Considerable operating data for my hydrokinetic amplifier shows C values of more than 0.7, and there is reason to believe that 0.8 and possibly even 0.9 can be exceeded.

The F factor representing the efficiency of diffuser 15 can have a value of over 0.9 for diffusers filled with liquid. Prior art fluid heaters, probably for ease of start-up, use diffusers with F factors as low as 0.5. I prefer that diffuser 15 be substantially filled with liquid and have an efficiency factor F at least as high as 0.8.

Operational analysis also indicates that high vapor velocity and vapor mass flow rate at ingress region 14 improve performance for any purpose—whether the goal is pressure amplification, distillation, condensation, subatmospheric operation, or high temperature output. This also results in a high pressure gain, even under circumstances in which output pressure is not the primary objective.

I claim:

1. A hydrokinetic amplifier configured to receive liquid and vapor for condensing said vapor in said liquid, transferring the momentum of said vapor to said liquid, and increasing the pressure of said liquid substantially from input to output, said hydrokinetic amplifier comprising:

a. a liquid input nozzle;

b. a vapor input nozzle;

c. an acceleration chamber having an ingress region and an egress region;

d. a minimum cross-sectional area of said egress region being less than the cross-sectional area of a discharge region of said liquid input nozzle;

e. a wall of said acceleration chamber gradually converging from said ingress region toward said egress region;

f. a diffuser extending from said egress region downstream;

g. said liquid input nozzle being arranged to direct a free liquid jet into said ingress region so that liquid in said jet passes through said acceleration chamber without contacting said converging wall before reaching said egress region;

h. said vapor nozzle having a throat region arranged upstream of a discharge region of said liquid input nozzle and an expanding region arranged from said throat region downstream toward said ingress region so that vapor passing beyond said throat region is expanding upon reaching said discharge region of said liquid nozzle; and i. said vapor nozzle being arranged for directing said expanding vapor to surround and travel in the direction of said free liquid jet, whereby substantially more than half of said expanding vapor contacts and condenses in said free liquid jet, transferring momentum from said vapor to said liquid to accelerate said liquid toward said egress region so that:

$$\frac{P_{out}}{P_{in}} \cong \frac{\Delta P_{out}}{\Delta P_{in}} = F\frac{V_{L2out}}{V_{L2in}} = FC^2\frac{\left(\frac{M_V V_V}{M_L V_L}+1\right)^2}{\left(1+\frac{M_V}{M_L}\right)^2}$$

where:

F=efficiency of said diffuser

C=portion of vapor momentum transferred to liquid $M_V$=vapor mass flow rate $M_L$=liquid mass flow rate $V_V$=vapor velocity at said ingress region $V_L$=liquid velocity at said ingress region $P_{in}$=liquid pressure input $P_{out}$=liquid pressure output $\Delta P_{out}=P_{out}$—internal pressure at egress region $\Delta P_{in}=P_{in}$—internal pressure at ingress region and wherein C is at least about 0.6.

2. The hydrokinetic amplifier of claim 1 wherein said vapor nozzle is configured to produce maximum thrust.

3. The hydrokinetic amplifier of claim 1 wherein said liquid and vapor input nozzles and said acceleration chamber are arranged so that at least about 90% of said vapor condenses in said free liquid jet before reaching said egress region.

4. The hydrokinetic amplifier of claim 1 wherein the cross-sectional area of said egress region is about 10% larger than the cross-sectional area of the liquid stream passing through said egress region.

5. A hydrokinetic amplifier configured to receive liquid and vapor for condensing said vapor in said liquid and transferring the momentum of said vapor to said liquid, said hydrokinetic amplifier comprising:

a. a liquid input nozzle;

b. a vapor input nozzle;

c. an acceleration chamber having an ingress region and an egress region;

d. a minimum cross-sectional area of said egress region being less than the cross-sectional area of a discharge region of said liquid input nozzle;

e. a wall of said acceleration chamber gradually converging from said ingress region toward said egress region;

f. a diffuser extending from said egress region downstream;

g. said liquid input nozzle being arranged to direct a free liquid jet into said ingress region so that liquid in said jet passes through said acceleration chamber without contacting said converging wall before reaching said egress region; and h. said vapor nozzle extending from upstream of a discharge region of said liquid input nozzle and having a throat region arranged for directing vapor to surround said free liquid jet at said discharge region of said liquid input nozzle and to travel in the direction of said free liquid jet for a sufficient distance so that substantially more than half of said vapor contacts and condenses in said free liquid jet, transferring momentum from said vapor to said liquid to accelerate said liquid toward said egress region so that:

$$\frac{P_{out}}{P_{in}} \cong \frac{\Delta P_{out}}{\Delta P_{in}} = F\frac{V_{L2out}}{V_{L2in}} = FC^2\frac{\left(\frac{M_V V_V}{M_L V_L}+1\right)^2}{\left(1+\frac{M_V}{M_L}\right)^2}$$

where:

F=efficiency of said diffuser

C=portion of vapor momentum transferred to liquid $M_V$=vapor mass flow rate $M_L$=liquid mass flow rate $V_V$=vapor velocity at said ingress region $V_L$=liquid velocity at said ingress region $P_{in}$=liquid pressure input $P_{out}$=liquid pressure output $\Delta P_{out}=P_{out}$—internal pressure at egress region $\Delta P_{in}=P_{in}$—internal pressure at ingress region and wherein C is at least about 0.6 and F is at least about 0.8.

6. The hydrokinetic amplifier of claim 5 wherein said liquid and vapor input nozzles and said acceleration chamber are arranged so that at least about 90% of said vapor condenses in said free liquid jet before reaching said egress region.

7. The hydrokinetic amplifier of claim 5 wherein said vapor nozzle and said acceleration chamber are arranged so that said vapor reaches sonic velocity in said throat region.

8. The hydrokinetic amplifier of claim 5 wherein the cross-sectional area of said egress region is about 10% larger than the cross-sectional area of the liquid stream passing through said egress region.

9. A hydrokinetic amplifier configured to receive liquid and vapor for condensing said vapor in said liquid and transferring the momentum of said vapor to said liquid, said hydrokinetic amplifier comprising:

a. a liquid input nozzle;

b. a vapor input nozzle;

c. means for supplying vapor at subatmospheric pressure to said vapor nozzle;

d. an acceleration chamber having an ingress region and an egress region;

e. a wall of said acceleration chamber gradually converging from said ingress region toward said egress region;

f. a diffuser extending from said egress region downstream;

g. said liquid input nozzle being arranged to direct a free liquid jet into said ingress region so that liquid in said jet passes through said acceleration chamber without contacting said converging wall before reaching said egress region; and h. said vapor nozzle being arranged for directing said subatmospheric pressure vapor to surround and travel in the direction of said free liquid jet for a sufficient distance so that substantially more than one-half of said vapor contacts and condenses in said free liquid jet, transferring momentum from said vapor to said liquid to accelerate said liquid toward said egress region so that:

$$\frac{P_{out}}{P_{in}} \approx \frac{\Delta P_{out}}{\Delta P_{in}} = F\frac{V_{L2out}}{V_{L2in}} = FC^2\frac{\left(\frac{M_V V_V}{M_L V_L}+1\right)^2}{\left(1+\frac{M_V}{M_L}\right)^2}$$

where:

F=efficiency of said diffuser

C=portion of vapor momentum transferred to liquid $M_V$=vapor mass flow rate $M_L$=liquid mass flow rate $V_V$=vapor velocity at said ingress region $V_L$=liquid velocity at said ingress region $P_{in}$=liquid pressure input $P_{out}$=liquid pressure output $\Delta P_{out}=P_{out}$—internal pressure at egress region $\Delta P_{in}=P_{in}$—internal pressure at ingress region and wherein C is at least about 0.6.

10. The hydrokinetic amplifier of claim 9 wherein said vapor nozzle is configured to produce maximum thrust.

11. The hydrokinetic amplifier of claim 9 wherein said liquid and vapor input nozzles and said acceleration chamber are arranged so that at least about 90% of said vapor condenses in said free liquid jet before reaching said egress region.

12. The hydrokinetic amplifier of claim 9 wherein the cross-sectional area of said egress region is about 10% larger than the cross-sectional area of the liquid stream passing through said egress region.

13. The hydrokinetic amplifier of claim 9 including means for supplying liquid at subatmospheric pressure to said liquid input nozzle.

14. The hydrokinetic amplifier of claim 13 wherein the minimum cross-sectional area of said egress region is less than the cross-sectional area of a discharge region of said liquid input nozzle.

15. The hydrokinetic amplifier of claim 9 wherein the minimum cross-sectional area of said egress region is less than the cross-sectional area of a discharge region of said liquid input nozzle.

16. The hydrokinetic amplifier of claim 15 wherein said vapor nozzle is configured to produce maximum thrust.

17. The hydrokinetic amplifier of claim 16 wherein said liquid and vapor input nozzles and said acceleration chamber are arranged so that at least about 90% of said vapor condenses in said free liquid jet before reaching said egress region.

18. The hydrokinetic amplifier of claim 17 wherein the cross-sectional area of said egress region is up to about 10% larger than the cross-sectional area of the liquid stream passing through said egress region.

* * * * *